United States Patent [19]

Van Dongen et al.

[11] Patent Number: 4,988,536

[45] Date of Patent: Jan. 29, 1991

[54] METHOD FOR ACTIVATING A METAL SURFACE

[75] Inventors: Cornelis J. Van Dongen, Diepenveen; Gerrit H. F. Ter Horst, Schalkhaar, both of Netherlands

[73] Assignee: Thomassen & Drijver-Verblifa N.V., Netherlands

[21] Appl. No.: 444,543

[22] Filed: Dec. 1, 1989

[30] Foreign Application Priority Data

Dec. 2, 1988 [NL] Netherlands ..... 8802982

[51] Int. Cl.[5] ..... B05D 3/06

[52] U.S. Cl. ..... 427/39; 427/47; 427/255.2; 427/255.5; 427/295

[58] Field of Search ..... 427/39, 47, 255.2, 255.5, 427/295

[56] References Cited

U.S. PATENT DOCUMENTS 3,783,826 1/1974 Urbanek et al. ..... 427/39 X
4,235,187 11/1980 Mirza ..... 118/58

FOREIGN PATENT DOCUMENTS 239205 5/1960 Australia ..... 427/39
8201482 11/1981 PCT Int'l Appl. .

*Primary Examiner*—Bernard Pianalto
*Attorney, Agent, or Firm*—Webb, Burden, Ziesenheim & Webb

[57] ABSTRACT

The invention has for its object to offer a method using which a metal surface displays improved properties. These improved properties are in particular an improved flow of lacquer of the like over the surface, the adhesion of this lacquer to that surface and a general improvement in the lacquering and printing qualities of a metal surface.

The invention provides a method for activating a metal surface, for example for improving the flow of lacquer over and/or the adhesion of lacquer to a tin surface, comprising the steps of:

(1) providing a lightly greased or oiled metal surface, for example the surface of a tin plate of strip;

(2) subjecting that metal surface to a corona discharge through application of an alternating voltage between that metal surface and a conductor situated thereabove.

26 Claims, 3 Drawing Sheets

METHOD FOR ACTIVATING A METAL SURFACE

Figure 1:
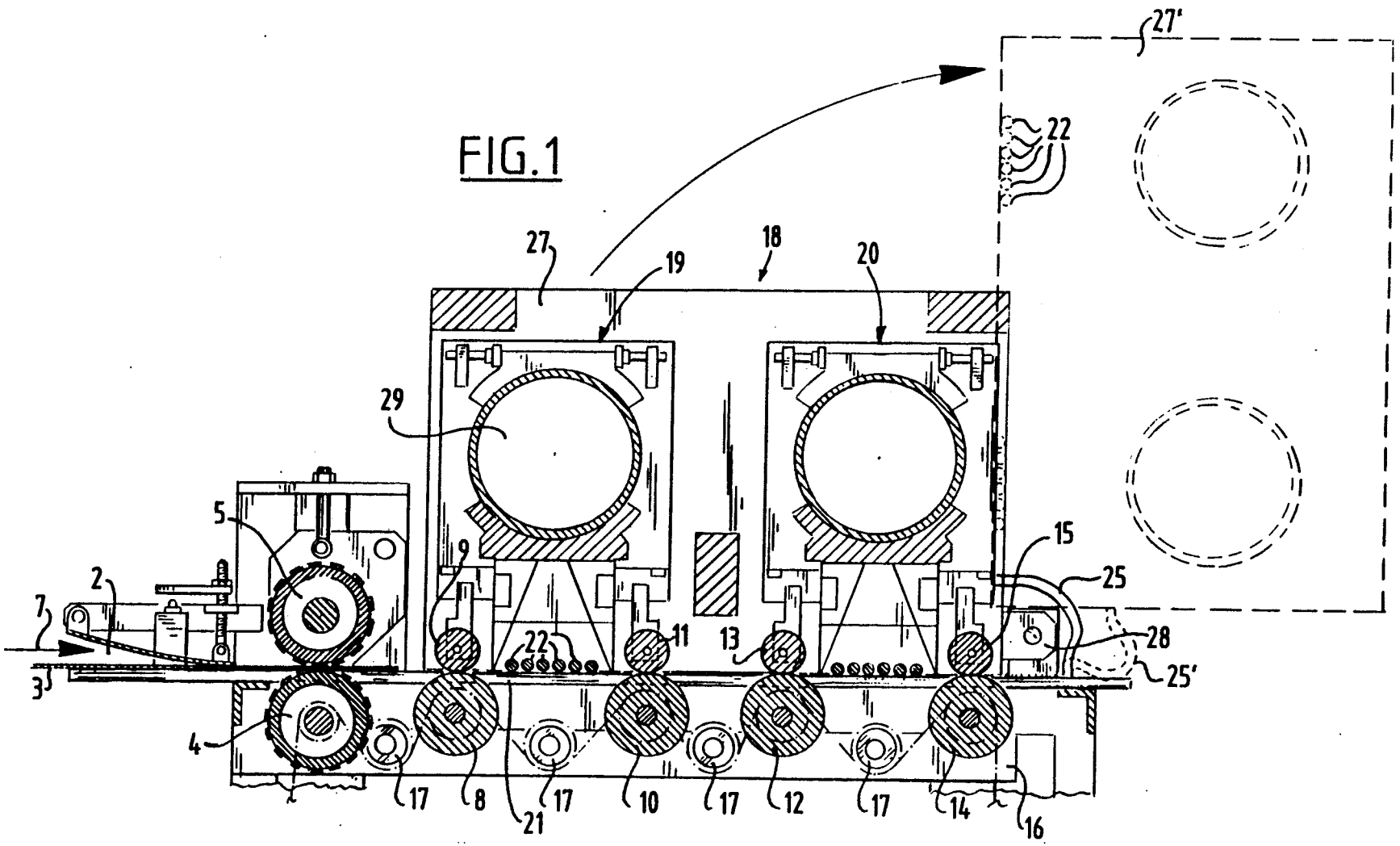

The invention has for its object to offer a method using which a metal surface displays improved properties. These improved properties are in particular an improved flow of lacquer or the like over the surface, the adhesion of this lacquer to that surface and a general improvement in the lacquering and printing qualities of a metal surface.

According to a known method the metal surface is subjected to a heat treatment. It has been found that this treatment can achieve the sought after effects reasonably effectively. The method does however have the drawback of being expensive.

With another method the surface is subjected for a short time to a flame or a very short-lasting heat pulse. Such a method has the drawback of not always being completely manageable.

The invention now provides a method for activating a metal surface, for example for improving the flow of lacquer over and/or the adhesion of lacquer to a tin surface, comprising the steps of:

(1) providing a lightly greased or oiled metal surface, for example the surface of a tin plate or strip;

(2) subjecting that metal surface to a corona discharge through application of an alternating voltage between that metal surface and a conductor situated thereabove.

It is noted that the use of a corona discharge for treating plastic surfaces is known.

It will be apparent that in the case of an electrically conducting product or article, for example a tin plate or strip, this product can be carried over a conducting base, for example while simultaneously being pressed thereon by pressure rollers, whereby the conductor extends in a transverse direction relative to the transporting direction of the product. Hereby achieved in a continuous through-feed is that one of both surfaces of the product can be treated. If required both sides of the product can be consecutively treated in one line.

It is noted that many products are already lightly greased or oiled during manufacture. The purpose of such a treatment can on the one hand be to provide a certain lubrication whereby the surfaces of the plates for stacking can slide over each other more easily, while on the other hand the greasy covering layer can form an oxygen barrier in order to counter corrosion.

A frequency in the order of 15–40 kHz is preferably used.

The corona voltage can be in the order of 10 kV.

With a method wherein the metal surface is carried past a transverse conductor which is provided with a dielectric jacket, a well functioning corona treatment can be effectively performed and nevertheless avoid the danger of sparkover. The dielectric covering layer or jacket ensures a high strength of field and a good homogeneity of the corona discharge.

Very good results are achieved with a corona discharge wherein the energy density lies between 45 and 90 watts per running centimeter of transverse conductor. Below this region the effectiveness of the treatment is irregular, while above this value a certain "saturation" occurs. In other words, it is well possible to increase the energy density but this is not accompanied by increasing effectiveness of the treatment and is therefore undesirable from an economic point of view.

In preference a method is used wherein the grease 35 or oil concentration lies in the order of 0.8–15 mg per $m^2$. Use can particularly be made of ester-based lubricants such as DOS (dioctyl sebacate) ATBC (acetyl tributyl citrate) and/or BSO (butyl stearate/palmitate).

The dielectric can comprise for example sinter materials, plastics such as hypalon and/or silicon rubbers, alone or in combination.

The corona discharge can advantageously take place in the surrounding air. As a consequence of the corona discharge a part of the oxygen present in the air is converted into ozone. This ozone can bring about a chemical activation of the metal surface.

Use can also be made of additional reactive components, e.g. a reactive gas such as chlorine, one or more amines, aldehydes, and/or unsaturated organic compounds. These compounds generally have to be of the type capable of starting radical-reactions. The types mentioned as examples are capable thereof.

A good effectiveness is acquired with a method wherein the distance chosen between the metal surface and the conductor is a maximum of approximately 1.5 mm.

It has been found that the distance chosen between the metal surface and the electrode is preferably smaller the higher the frequency chosen.

In order to cause the homogeneity of the treatment over the surface to be as good as possible the method is recommended in which steps are taken to ensure the flatness of the metal surface at the location of the conductor such that the distance between the metal surface and the conductor is substantially constant.

This method can for example be performed such that the article of which the metal surface forms a part can be held by making use of underpressure on a supporting surface, for example a perforated or divided endless conveyor belt with an underpressure source connected thereunder.

The article or product of which the metal surface is a part can also be held on a supporting surface by using magnetic forces.

It is also possible to roll the plate beforehand.

The invention further relates to an apparatus intended for performing the above described method. This apparatus comprises:

(1) means for the positioning of an article with a metal surface;

(2) a conductor to be placed in the vicinity of that metal surface; and (3) means for applying an alternating voltage between the metal surface and the conductor such that a corona discharge takes place between both.

Finally, the invention relates to the use of the apparatus specified in the previous paragraph for performing the method according to the invention.

The invention further relates to an article or product having a metal surface which is treated with one of the methods described above.

The invention can be used for improving the properties of a metal surface on which it is the wish to lacquer and/or print.

The surface in question can form part of an article or product (semi-manufactures such as metal plates or strips), tin (iron with a covering layer of tin), aluminium, chrome-passivated steel or ECCS (electrochromium coated steel) or pure steel or "blackplate".

The treatment according to the invention gives great durability in the lacquering and printing qualities. Tests have demonstrated that up to approximately four months after the treatment no decrease whatever can be discerned in the lacquering and/or printing qualities. It is thus apparent that the method according to the invention leads to a very stable result.

Figure 2:
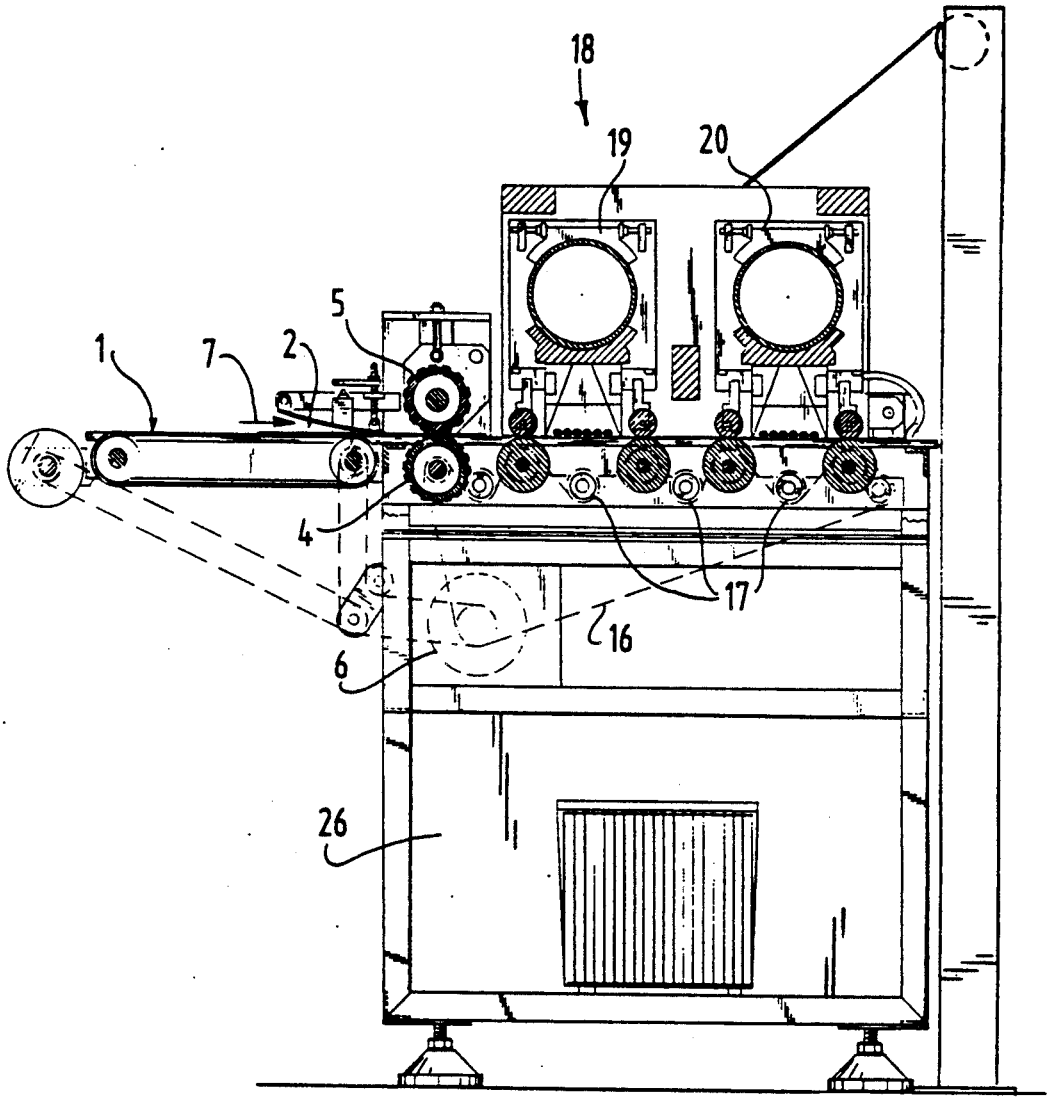
Figure 4:
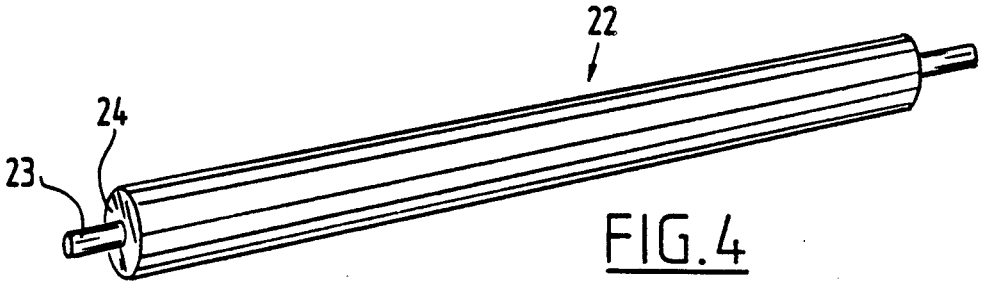
Figure 3:
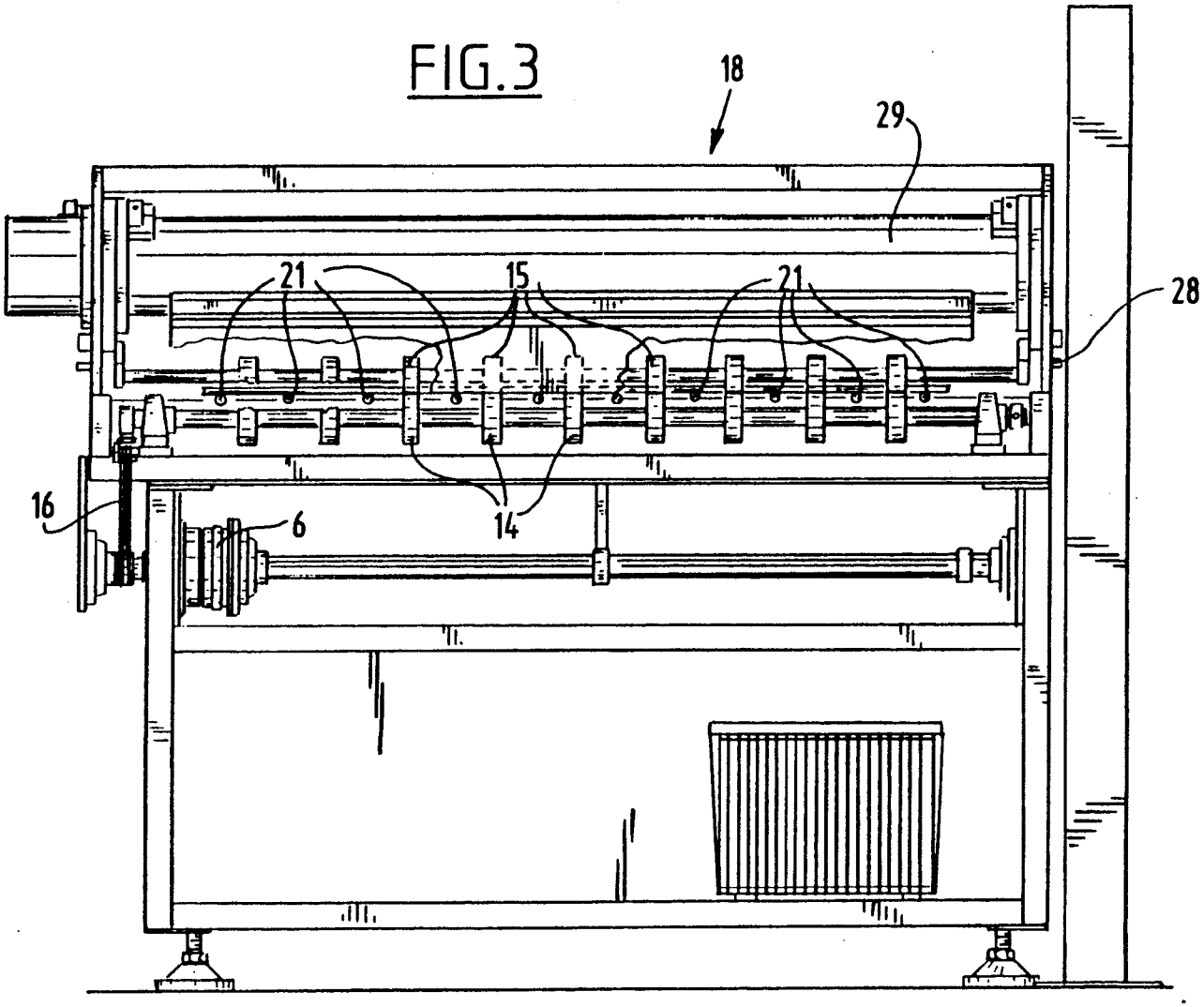

The invention will now be explained with reference to the accompanying drawings. In the drawings:

FIG. 1 is a schematic longitudinal section of an apparatus according to the invention;

FIG. 2 partially in side elevation and partially in longitudinal section according to FIG. 1 a total transport and treating apparatus having an apparatus according to FIG. 1;

FIG. 3 is a rear elevation, i.e. an elevation view at the output side of the apparatus according to FIG. 2; and FIG. 4 is a perspective view of a corona-electrode.

A supply conveyor 1 serves for supplying in a supply pinch 2 flat metal plates 3 between the pinch of two supply rollers 4, 5, said roller 4 being driven by an electro-motor 6 in a manner to be herein described below, and said roller 5 being spring-loaded in the direction of supply roller 4 and being freely rotatable.

The convey- or transport-direction of metal plates 3 is indicated with an arrow 7.

Downstream relative to rollers 4, 5 the roller pairs 8, 9, 10, 11, 12, 13 and 14, 15 are positioned. Rollers 8, 10, 12, 14 are simultaneously with supply roller 4 driven by means of a chain 1 by means of electro-motor 6. Between the respective rollers 4, 8, 10, 12 and 14 reversing rollers indicated with 17 are arranged.

Said rollers 9, 11, 13, 15 are spring-loaded in the direction of the driven rollers 8, 10, 12, 14. Thus a positive transport of the conveyed plates 3 to be treated is ensured.

The apparatus 18 according to the invention and shown in FIGS. 1, 2 comprises two corona-stations 19, 20. Station 19 treats plates in the region between the roller pairs 8, 9 and 10, 11, whilst station 20 is arranged downstream relative thereof and subjects the plates treated by station 19 to another corona-treatment in the region between roller pairs 12, 13 and 14, 15.

The corona-stations 19, 20 are identical. For the sake of ease therefore only station 19 will be discussed.

During the transport of metal plates 3 by the apparatus 18 the plates are carried by support bars 21 (see FIG. 3). In this embodiment it also should be noted that rollers 8–15 are actually designed as shown in FIG. 3, namely each as rows of nine rollers arranged on one common shaft. FIG. 3 shows the rows of rollers 14 and 15.

The corona-station 19 (and 20) comprises six corona-electrodes 22. Such an electrode is shown on an enlarged scale in FIG. 4 and comprises a rest-proof core 24 and a ceramic jacket 24. The corona-electrodes 22 are arranged in a common horizontal plain on a certain distance of support bars 21, in such a way that they have also a desired distance relative to the conveyed metal plates 3. By means of a cable 25 the corona-electrodes 22 are connected with an adjustable high-tension generator 26, the earth side of which is connected with earth, of the total frame, of the apparatus 18. Also support bars 21 are conductively connected with said frame, such that the high-tension generator 26 generates a high tension between the cores 23 of the corona-electrodes 22, on the one hand, and the upper surface of the transported metal plates 3, on the other hand, which, as mentioned, shift during transport by rollers 8–15 electrically conductive lay over support bars 21.

As a result of the presence of the dielectric ceramic jacket 24 between this jacket 24 and the upper surface of a passing metal plate 3 a strong electric field is generated. As a result thereof this mentioned upper surface of the related metal plate is subjected to a corona-discharge.

In corona-station 19 the full surface is subjected by six successive electrodes 22 to six corona-treatments, followed by the same series of treatments in corona-station 20.

A hood 27 serves as cover for the corona-stations 19, 20. The hood can be hingedly removed by means of a hinge 28 into the position shown with interrupted lines and indicated with 27'. In this position the interior of the apparatus is excessible, e.g. for service purposes.

Over electrodes 22 fan-means 29 are arranged for sucking off ozone-gas generated by the corona-discharge. The poisonous ozone-gas can, by means of means not-shown be removed to a place, where is it harmless.

It will be obvious that the lengths of the corona-electrodes 22 has to be at least equal to the width of the conveyed metal plates 3.

What is claimed is:

1. A method for activating a metal surface of an article, comprising the steps of:

(1) providing a metal surface having a lubricant lightly applied thereto; and (2) subjecting the metal surface to a corona discharge by applying an alternating voltage, between the metal surface and a conductor situated thereabove.

2. A method as claimed in claim 1, the alternating voltage has a frequency of approximately 15–40 kHz.

3. A method as claimed in claim 1, wherein the voltage between the metal surface and the conductor is in order of 10 kV.

4. A method as claimed in claim 1, further comprising carrying the metal surface past at least one transverse conductor with a dielectric jacket.

5. A method as claimed in claim 4 wherein the transverse conductor has an energy density in the order of 45–90 watts per running centimeter.

6. A method as claimed in claim 4, wherein the dielectric comprises a sinter material.

7. A method as claimed in claim 4 wherein the dielectric comprises hypalon.

8. A method as claimed in claim 4 wherein the dielectric comprises silicon rubber.

9. A method as claimed in claim 1 wherein the lubricant concentration is in the order of 0.8–15 mg per $m^2$.

10. A method as claimed in claim 1 wherein the lubricant comprises ester-based lubricants.

11. A method as claimed in claim 1, wherein the corona discharge takes place in the surrounding air.

12. A method as claimed in claim 11, further comprising maintaining the surround air at a temperature of approximately 20° C. and a relative humidity of approximately 50%.

13. A method as claimed in claim 1, wherein the corona discharge takes place in the presence of additional reactive components.

14. A method as claimed in claim 13 wherein the reactive components is selected from the group consisting of chlorine gas, one or more amines, aldehydes and unsaturated organic compounds.

15. A method as claimed in claim 1, wherein a maximum distance between the metal surface and the conductor is approximately 1.5 mm.

16. A method as claimed in claim 1, wherein a distance between the metal surface and the electrode decreases when the alternating voltage frequency increases.

17. A method as claimed in claim 1, further comprising maintaining the distance between said metal surface and said conductor substantially constant.

18. A method as claimed in claim 17, further comprising applying underpressure to the article so that the article is held on a supporting surface.

19. A method as claimed in claim 18 wherein the supporting surface comprises a perforated or divided endless conveyor belt with an underpressure source connected thereunder.

20. A method as claimed in claim 18 wherein the supporting surface comprises a divided endless conveyor belt with an underpressure source connected thereunder.

21. A method as claimed in claim 17, wherein the article is held on a supporting surface by magnetic forces.

22. A method as claimed in claim 17, wherein the plate comprises a flat rolled plate.

23. A method as claimed in claim 1 wherein the lubricant is selected from the group consisting of grease and oil.

24. A method as claimed in claim 21 wherein the lubricant concentration is in the order of 0.8–15 mg. per $m^2$.

25. A method as claimed in claim 1, wherein the lubricant is selected from the group consisting of DOS (dioctyl sebacate), ATBC (acetyl tributyl citrate) and BSO (butyl stearate/palmitate).

26. A method for activating a metal surface of an article, comprising the steps of:

(1) providing a metal surface having a lubricant lightly applied thereto, (2) moving the metal surface past at least one transverse conductor spaced therefrom, and (3) applying an alternating voltage between the metal surface and the conductor and subjecting the metal surface to a corona discharge.

* * * * *

UNITED STATES PATENT AND TRADEMARK OFFICE

CERTIFICATE OF CORRECTION

PATENT NO. : 4,988,536

DATED : January 29, 1991

INVENTOR(S) : Cornelis J. Van Dongen and Gerrit H. F. Ter Horst

It is certified that error appears in the above-identified patent and that said Letters Patent is hereby corrected as shown below:

Column 2 Line 1 after "grease" delete --35--.

Column 3 Line 46 "embodiment" should read --connection--.

Claim 2 Line 32 Column 4 after "claim 1," insert --wherein--.

Claim 24 Line 6 Column 6 "21" should read --23--.

Signed and Sealed this

Twenty-third Day of June, 1992

*Attest:*

DOUGLAS B. COMER

*Attesting Officer*

*Acting Commissioner of Patents and Trademarks*